US008152393B2

(12) United States Patent
Tsuchiya et al.

(10) Patent No.: US 8,152,393 B2
(45) Date of Patent: Apr. 10, 2012

(54) PRINTER DEVICE WITH BLADE DRIVING MOTOR AND PLATEN MOTOR PROVIDED ON A FIRST FRAME

(75) Inventors: Masahiro Tsuchiya, Shinagawa (JP); Yukihiro Mori, Shinagawa (JP); Sumio Watanabe, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 772 days.

(21) Appl. No.: 11/984,682

(22) Filed: Nov. 20, 2007

(65) Prior Publication Data

US 2008/0260448 A1 Oct. 23, 2008

(30) Foreign Application Priority Data

Apr. 23, 2007 (JP) ..... 2007-113187

(51) Int. Cl.
*B41J 11/70* (2006.01)
*B41J 23/02* (2006.01)
*B41J 29/02* (2006.01)

(52) U.S. Cl. ..... 400/621; 400/691; 400/693

(58) Field of Classification Search ..... 400/621, 400/693, 691, 663
See application file for complete search history.

(56) References Cited

U.S. PATENT DOCUMENTS

| | | | | |
|---|---|---|---|---|
| 4,523,825 | A * | 6/1985 | Norris | 396/580 |
| 5,006,865 | A | 4/1991 | Kuroiwa | |
| 5,579,043 | A | 11/1996 | Patry | |
| 5,993,093 | A * | 11/1999 | Schoennauer et al. | 400/621 |
| 6,964,475 | B2 | 11/2005 | Nebashi et al. | |
| 7,118,208 | B2 | 10/2006 | Nebashi et al. | |
| 7,828,490 | B2 * | 11/2010 | Nihashi et al. | 400/693 |
| 2004/0096256 | A1 * | 5/2004 | Hayashi et al. | 400/621 |
| 2004/0100549 | A1 | 5/2004 | Nebashi et al. | |
| 2005/0036820 | A1 * | 2/2005 | Watanabe et al. | 400/621 |
| 2005/0207813 | A1 * | 9/2005 | Takabatake et al. | 400/88 |
| 2005/0207818 | A1 * | 9/2005 | Tsuchiya et al. | 400/621 |
| 2008/0152417 | A1 * | 6/2008 | Heaton et al. | 400/693 |

FOREIGN PATENT DOCUMENTS

| | | | |
|---|---|---|---|
| EP | 1 156 002 | | 11/2001 |
| EP | 1 595 710 | | 11/2005 |
| FR | 2 697 776 | | 5/1994 |
| JP | 61120565 | A * | 6/1986 |
| JP | 04363270 | A * | 12/1992 |
| JP | 05169398 | A * | 7/1993 |
| JP | 9238225 | | 9/1997 |
| JP | 11245465 | | 9/1999 |
| JP | 2000052291 | A * | 2/2000 |
| JP | 2002144657 | | 5/2002 |
| JP | 2004114302 | | 4/2004 |
| JP | 2005-59395 | | 3/2005 |
| KR | 10-2004-0004175 | | 1/2004 |

OTHER PUBLICATIONS

Extended European Search Report issued Aug. 27, 2008 in corresponding European Patent Application No. 07121193.2.

(Continued)

*Primary Examiner* — Daniel J Colilla
(74) *Attorney, Agent, or Firm* — Staas & Halsey LLP

(57) ABSTRACT

A printer device is disclosed that has a cutter function and a thermal head, and is low profile but is suitable for thick paper. The printer device includes a first module and a second module. The first module includes a turning blade driving motor, a platen roller driving motor, a platen roller driven to rotate by the platen roller driving motor, and a fixed blade provided on a first frame. The second module includes a printing head and a turning blade provided on a second frame. When the first module and the second module are connected together, the printing head faces the platen roller, the turning blade faces the fixed blade, and rotation of the turning blade driving motor is transmitted to the turning blade.

26 Claims, 15 Drawing Sheets

OTHER PUBLICATIONS

English Abstract of Japanese Publication No. 9238225 Published Sep. 9, 1997.
English Abstract of Japanese Publication No. 11245465 Published Sep. 14, 1999.
English Abstract of Japanese Publication No. 2002144657 Published May 22, 2002.
English Abstract of Japanese Publication No. 2004114302 Published Apr. 15, 2004.

* cited by examiner

PRINTER DEVICE WITH BLADE DRIVING MOTOR AND PLATEN MOTOR PROVIDED ON A FIRST FRAME

BACKGROUND OF THE INVENTION

1. Field of the Invention

The present invention is related to a printer device, and particularly, to a printer device having a cutter function and a thermal head.

2. Description of the Related Art

Small-size thermal printers are installed in POS terminals and ticketing terminals. In order to facilitate setting of paper, a thermal printer includes a first module and a second module which is detachably attached to the first module, and a cutter device is provided with the first module joined to the second module. The cutter device includes a plate-like fixed blade, which is fixed to the first module, and a plate-like movable blade, which is slidably attached to the second module; the movable blade moves to cross the fixed blade to cut the paper like scissors.

For example, Japanese Laid-Open Patent Application No. 2005-059395 (referred to as "reference 1" hereinafter) discloses a technique in this field.

The POS terminals and the ticketing terminals use roll paper as printing media. The roll paper used in the POS terminal or the ticketing terminal is 70 μm in thickness, and the cutter device described above can sufficiently cut such kind of paper.

Presently, for example, when making labels, sometimes, thermosensitive paper thicker than 150 μm is used. When the thickness of the paper is thicker than 150 μm, the load imposed on the cutter device when cutting the paper becomes large. For example, considering the plate-like movable blade, since the movable blade is relatively flexible, such a large load may shorten the service-life of the movable blade.

Further, when the thickness of the paper is thicker than 150 μm, the paper is more elastic, so that it is required that the channel for conveying the paper induces small resistance against movement of the paper.

SUMMARY OF THE INVENTION

The object of the present invention is to solve one or more problems of the related art.

According to a first aspect of the present invention, there is provided a printer device, comprising:

a first module; and a second module, wherein the first module includes a first frame, a turning blade driving motor, a platen roller driving motor, a platen roller driven to rotate by the platen roller driving motor, and a fixed blade, said turning blade driving motor, said platen roller driving motor, said platen roller, and said fixed blade are provided on the first frame, and the second module includes a second frame, a printing head, and a turning blade, said printing head, and said turning blade are provided on the second frame, when the first module and the second module are connected together, the printing head faces the platen roller, the turning blade faces the fixed blade, and rotation of the turning blade driving motor is transmitted to the turning blade.

As an embodiment, the first module further includes a turning blade driving gear series that is provided on the first frame to transmit the rotation of the turning blade driving motor, the second module further includes a turning blade gear provided at an end of the turning blade, when the first module and the second module are connected together, the turning blade gear meshes with one gear of the turning blade driving gear series.

According to a second aspect of the present invention, there is provided a printer device, comprising:

a first module; and a second module, wherein the first module includes a first frame, a turning blade driving motor, a platen roller driving motor, a platen roller driven to rotate by the platen roller driving motor, and a turning blade driven to rotate by the turning blade driving motor, said turning blade driving motor, said platen roller driving motor, said platen roller, and said turning blade are provided on the first frame, and the second module includes a second frame, a printing head, and a fixed blade, said printing head, and said fixed blade are provided on the second frame, when the first module and the second module are connected together, the printing head faces the platen roller, and the turning blade faces the fixed blade.

As an embodiment, when the first module and the second module are connected together, a straight line paper channel is formed between the first module and the second module, the printing head and the platen roller facing each other, and the turning blade and the fixed blade facing each other are arranged in order side by side at a place downstream in the paper channel.

As an embodiment, the first frame includes a main body at a center, and gear boxes on two sides of the main body and projecting out of the main body, the main body is depressed relative to the gear boxes on the two sides thereof, the second module is accommodated in the depression.

As an embodiment, the second module is movably attached to a place on an inner side of the gear boxes on two sides thereof.

As an embodiment, the second module is separatable from the first module.

As an embodiment, the turning blade includes an initializing spring for returning the turning blade to an initial position.

As an embodiment, the printer device further comprises:

a protection cover mechanism that locates a protection cover member at an escaping position when the first module and the second module are connected together, and moves the protection cover member at a covering position to cover at least one of the turning blade and the fixed blade when the first module and the second module are disconnected.

As an embodiment, the protection cover mechanism moves the protection cover member by an elastic force of a spring from the escaping position to the covering position.

As an embodiment, the spring projects out of the protection cover member and is integrated with the protection cover member.

As an embodiment, the turning blade includes a molded part serving as a main body of the turning blade, and a plate-like blade fixed to the main body.

As an embodiment, an end of a plate-like heat sink arranged on the printing head serves as the fixed blade.

As an embodiment, an end of a ceramic plate supporting the printing head serves as the fixed blade.

According to the present invention, when the first module and the second module are connected together, the turning blade and the fixed blade form a cutter device, paper jams can be dealt with easily, and a printer device suitable for thick paper is obtainable.

These and other objects, features, and advantages of the present invention will become more apparent from the following detailed description of the preferred embodiments given with reference to the accompanying drawings.

DESCRIPTION OF THE PREFERRED EMBODIMENTS

Below, preferred embodiments of the present invention are explained with reference to the accompanying drawings.

First Embodiment

Configuration and Operation

Figure 1A:
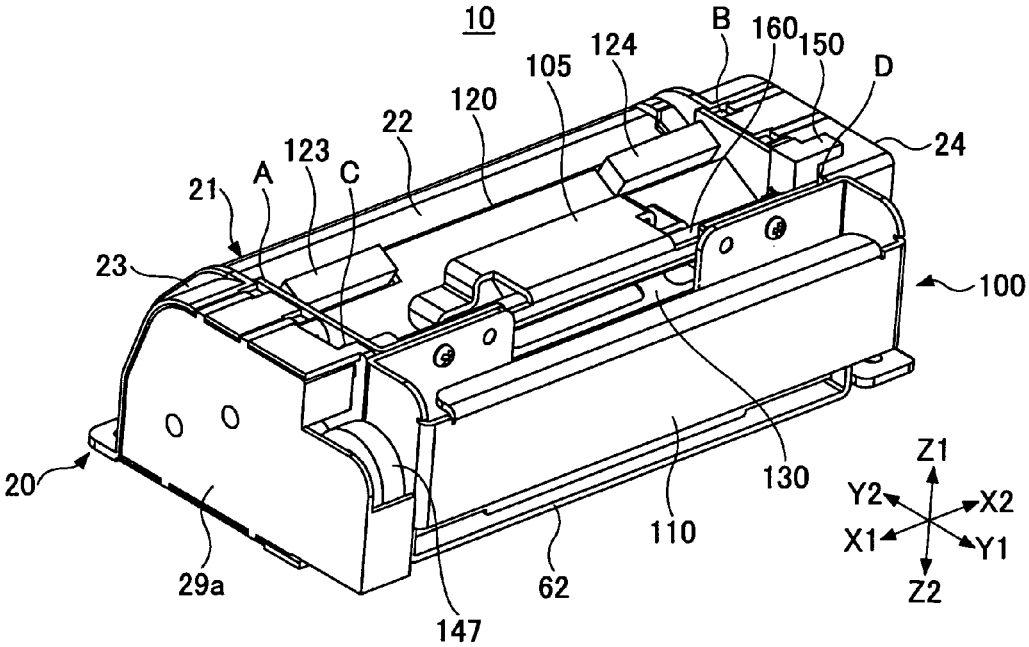
FIG. 1A is a perspective view illustrating a configuration of a thermal printer device 10 under a usual condition according to a first embodiment of the present invention.

FIG. 1A is a perspective view illustrating a configuration of a thermal printer device 10 under a usual condition according to a first embodiment of the present invention.

Figure 1B:
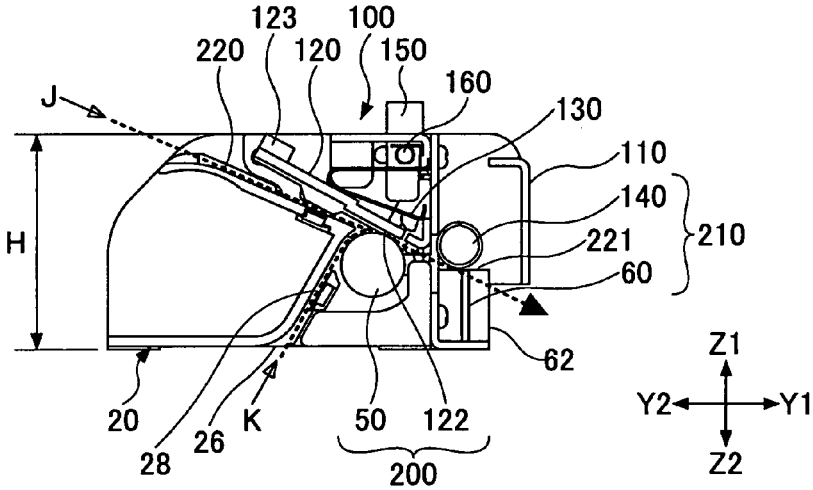
FIG. 1B is a cross-sectional view of the thermal printer device 10 as shown in FIG. 1A.

FIG. 1B is a cross-sectional view of the thermal printer device 10 as shown in FIG. 1A.

Figure 1C:
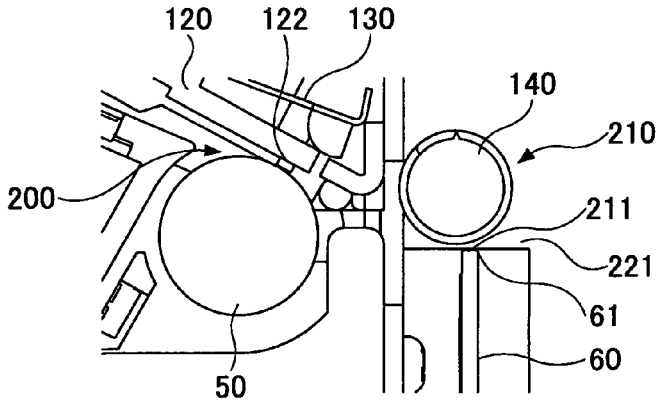
FIG. 1C is an enlarged cross-sectional view of a printer unit 200 and a cut unit 210 of the thermal printer device 10 as shown in FIG. 1A.

FIG. 1C is an enlarged cross-sectional view of a printer unit 200 and a cut unit 210 of the thermal printer device 10 as shown in FIG. 1A.

In FIG. 1A through FIG. 1C, a dual-direction arrow X1-X2 indicates a width direction of the thermal printer device 10, a dual-direction arrow Y1-Y2 indicates a depth direction of the thermal printer device 10, and a dual-direction arrow Z1-Z2 indicates a height direction of the thermal printer device 10.

The thermal printer device 10 as shown in FIG. 1A through FIG. 1C is of a line-printing type, and is suitable for any device capable of automatic paper feeding. The thermal printer device 10 includes a first module 20 and a second module 100, and the second module 100 is connected to the first module 20 by hinge joint so that the thermal printer device 10 can be opened and closed. The second module 100 is connected to the first module 20 at four locations so that the second module 100 overlaps the first module 20, and the second module 100 and the first module 20 are integrated as one piece. Specifically, the second module 100 is connected to the first module 20 at two locations A and C on the X1 side, and at two locations B and D on the X2 side. As a result, the printing unit 200 and the cutter unit 210 are formed, and a paper-channel 220 is formed. The cutter unit 210 has a turning blade.

Figure 7:
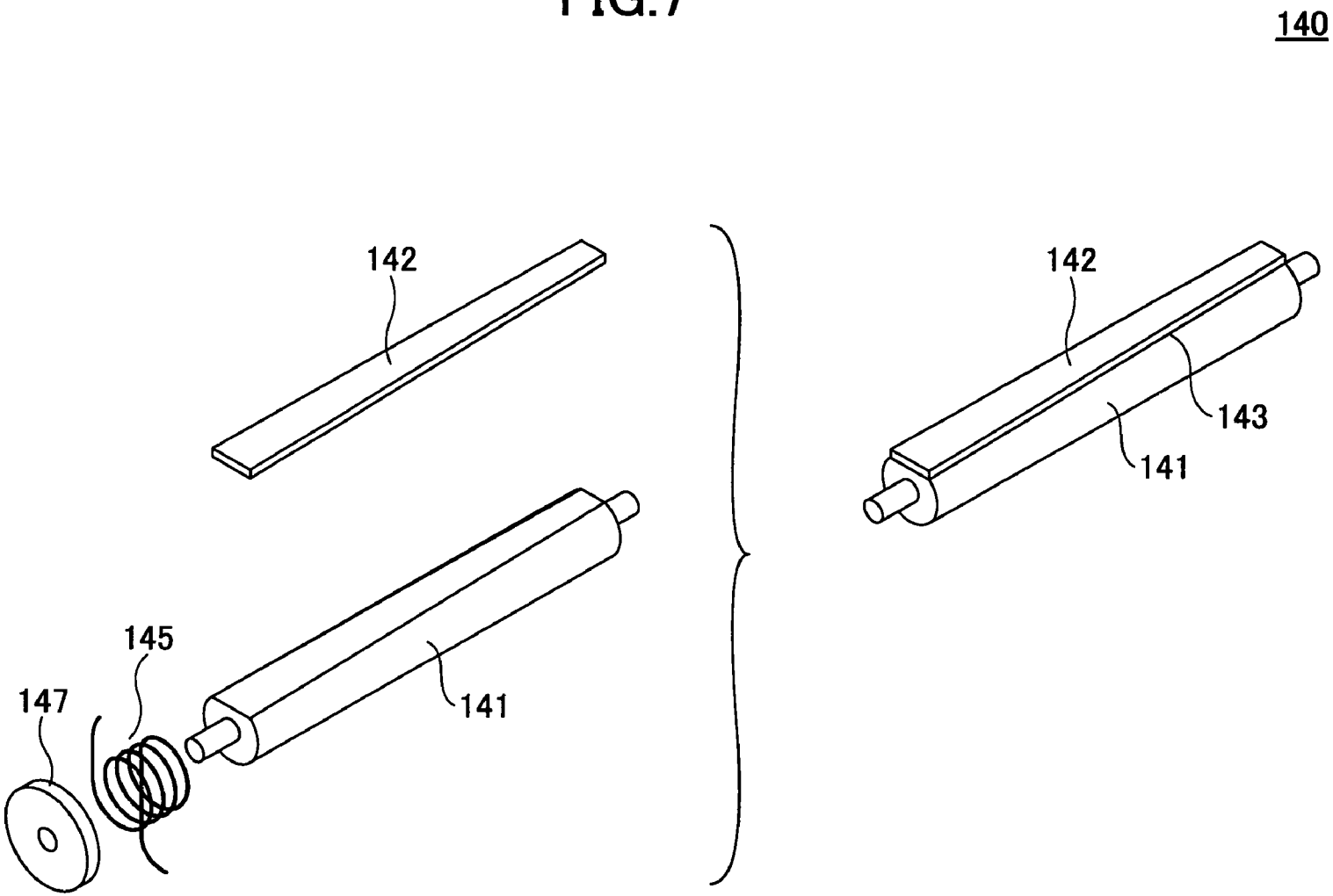
FIG. 7 is an exploded perspective view of a turning blade 140 in the cutter unit 210.

FIG. 7 is an exploded perspective view of a turning blade 140 in the cutter unit 210.

Returning to FIG. 1A through FIG. 1C, the paper moves from the Y2 side to the Y1 side along a straight line, printed by a thermal head, and is cut by the cutter unit 210 at the position of an exit.

Figure 2A:
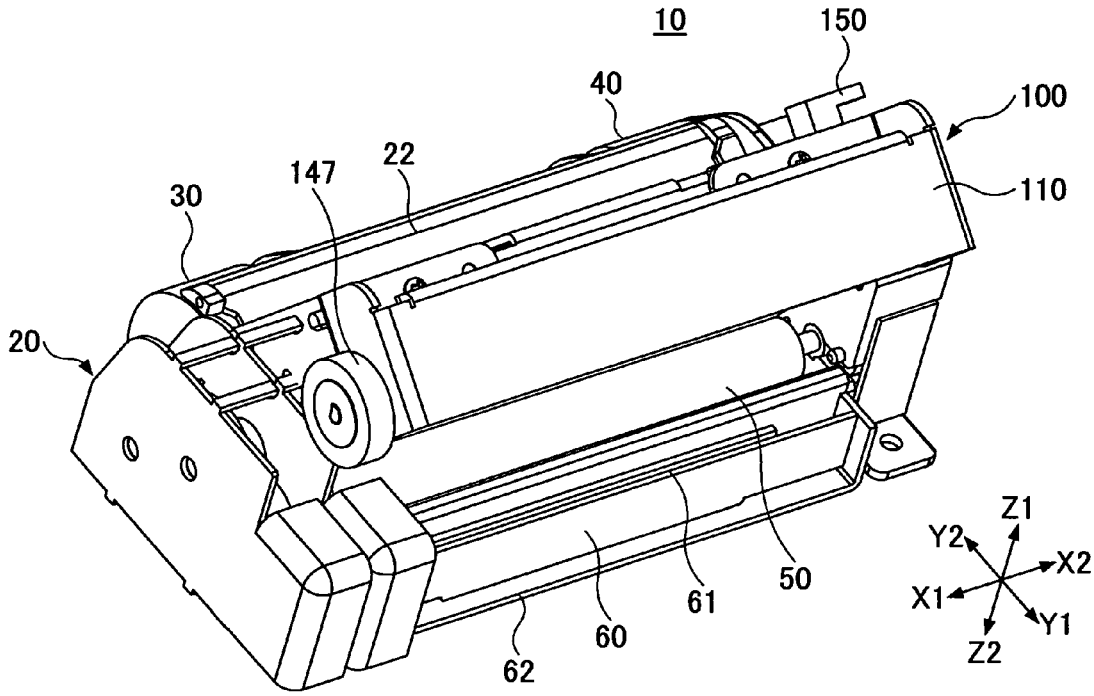
FIG. 2A is a perspective view illustrating a configuration of the thermal printer device 10 under a maintenance condition.

FIG. 2A is a perspective view illustrating a configuration of the thermal printer device 10 under a maintenance condition.

Figure 2B:
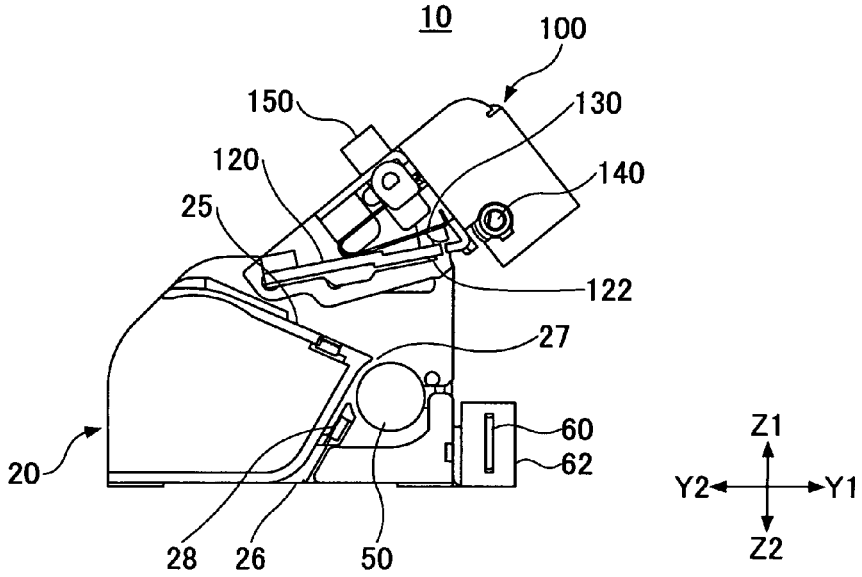
FIG. 2B is a cross-sectional view of the thermal printer device 10 as shown in FIG. 2A.

FIG. 2B is a cross-sectional view of the thermal printer device 10 as shown in FIG. 2A.

As shown in FIG. 2A and FIG. 2B, the second module 100 can be opened, for example, to remove jammed paper and restore the device to its usual condition.

First Module 20

Figure 3:
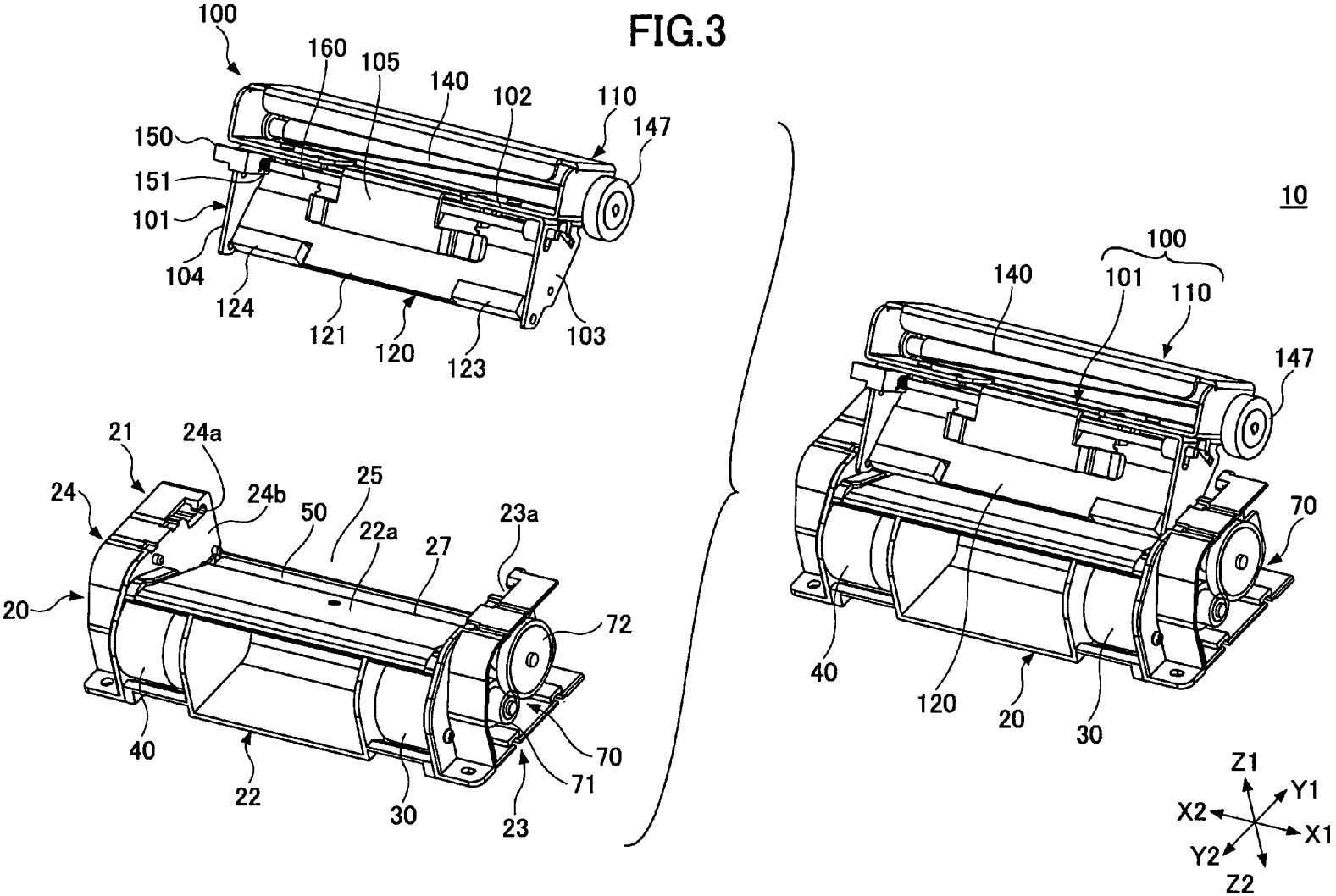
FIG. 3 is an exploded perspective view of the thermal printer device 10 under a maintenance condition.

FIG. 3 is an exploded perspective view of the thermal printer device 10 under maintenance condition.

Figure 4:
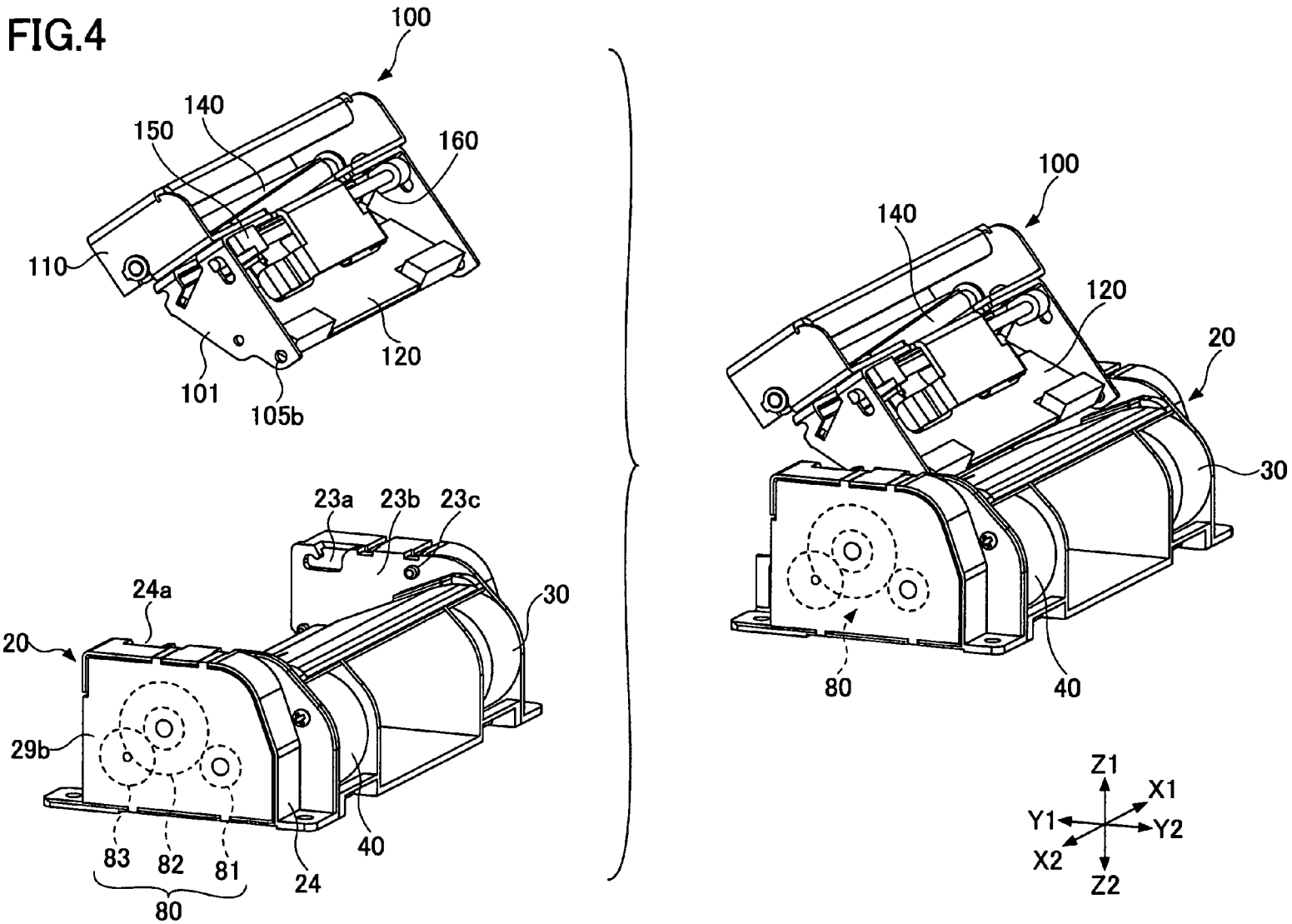
FIG. 4, continuing from FIG. 3, is an exploded perspective view of the thermal printer device 10 during maintenance viewed from a direction different from that in FIG. 3.

FIG. 4, continuing from FIG. 3, is an exploded perspective view of the thermal printer device 10 during maintenance viewed from a direction different from that in FIG. 3.

Figure 5:
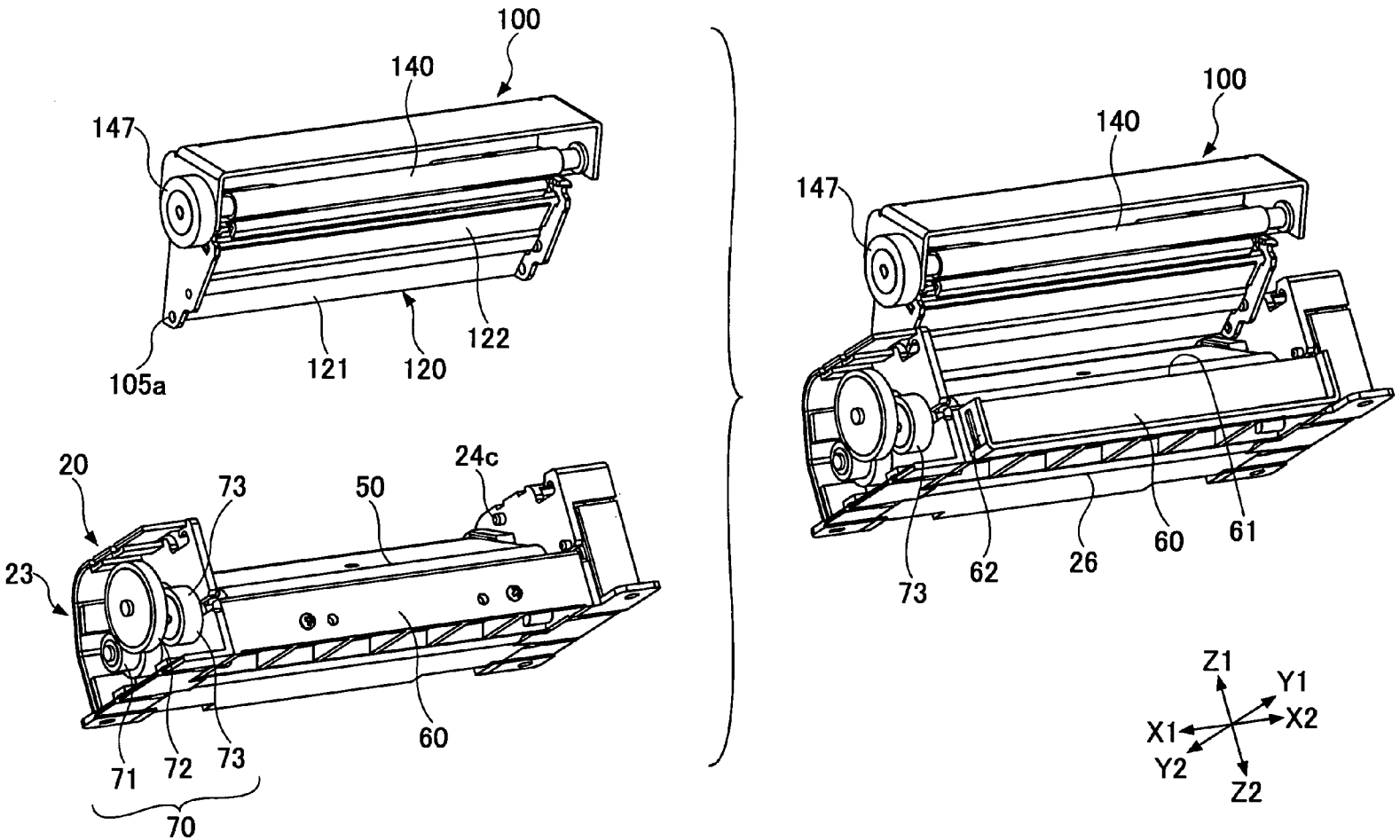
FIG. 5, continuing from FIG. 4, is an exploded perspective view of the thermal printer device 10 during maintenance viewed from a direction different from those in FIG. 3 and FIG. 4.

FIG. 5, continuing from FIG. 4, is an exploded perspective view of the thermal printer device 10 during maintenance viewed from a direction different from those in FIG. 3 and FIG. 4.

Figure 6:
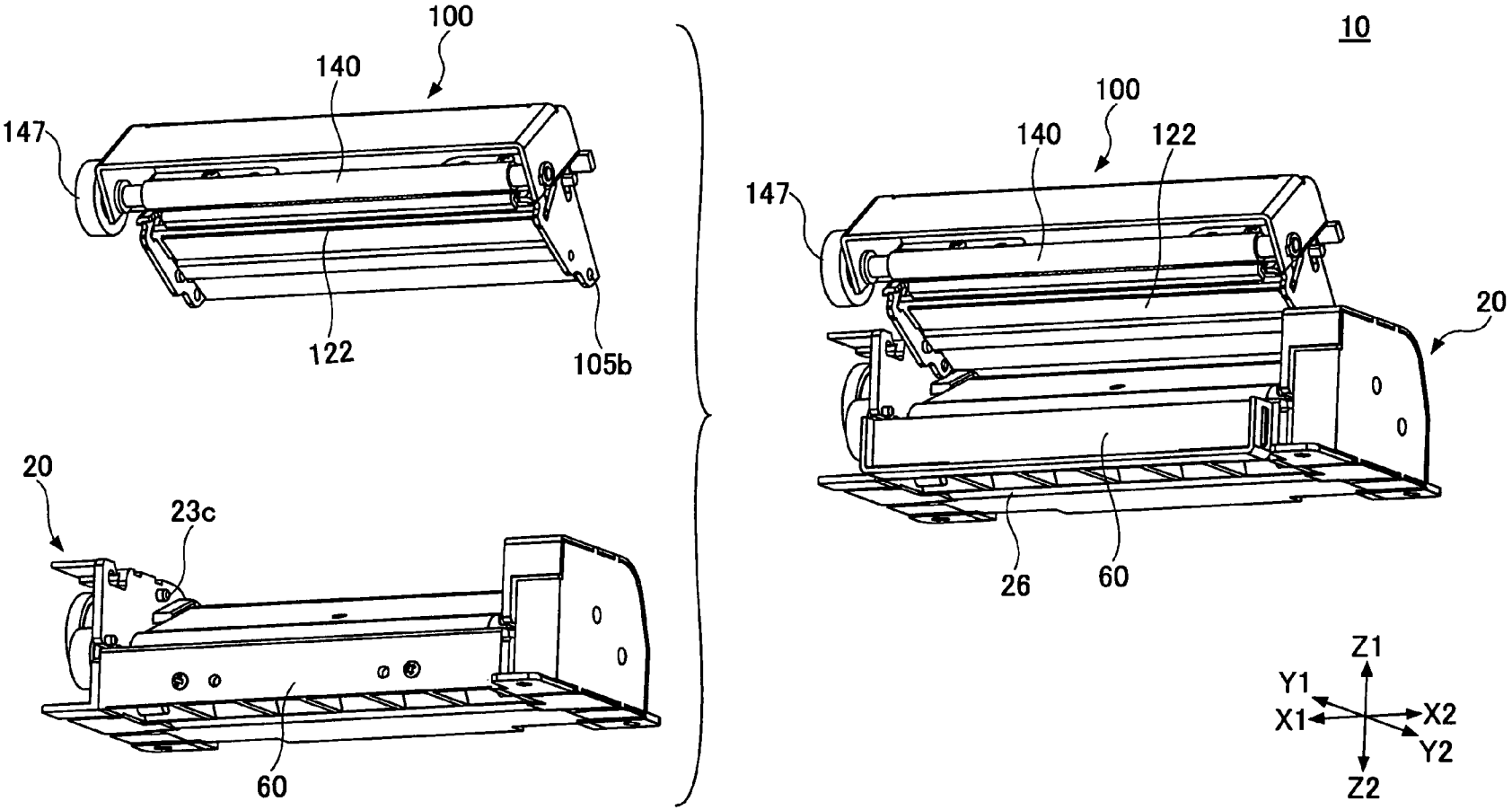
FIG. 6, continuing from FIG. 5, is an exploded perspective view of the thermal printer device 10 during maintenance viewed from a direction different from those in FIG. 3 through FIG. 5.

FIG. 6, continuing from FIG. 5, is an exploded perspective view of the thermal printer device 10 during maintenance viewed from a direction different from those in FIG. 3 through FIG. 5.

In FIG. 3 through FIG. 6, for sake of simplicity, illustration of gear teeth is omitted and gears are illustrated as circular plates. In addition, in FIG. 3 through FIG. 6, the dual-direction arrows X1-X2, Y1-Y2, Z1-Z2 indicate the same directions as those in FIG. 1A through FIG. 1C.

As shown in FIG. 3 through FIG. 6, the first module 20 includes a turning blade driving motor 30, a platen roller driving motor 40, a platen roller 50, a fixed blade 60, a turning blade driving gear series 70, and a platen roller driving gear series 80. The turning blade driving motor 30, the platen roller driving motor 40, the platen roller 50, and the fixed blade 60 are mounted on a first frame 21.

The first frame 21 is used by the first module 20, and is fabricated by die-casting. The first frame 21 has a main body 22 and gear boxes 23, 24 on the X1 side and the X2 side of the main body 22. The main body 22 is depressed relative to the gear boxes 23, 24. On the upper surface of the main body 22, there is a paper guide surface 22*a*, which is a flat surface extending in the X1-X2 direction and inclined downward (namely, the Z2 direction) in the Y1-Y2 direction.

Above the upper surface of the main body 22, a space 25 exits between the gear boxes 23, 24, which project out of the main body 22. The space 25 is used for accommodating the second module 100.

As shown in FIG. 1B and FIG. 2B, the main body 22 has a paper-feeding entrance 26 near a center of the bottom thereof.

On the Z1 side of the gear boxes 23, 24, cut-outs 23*a*, 24*a* are formed to engage with ends of a lock-shaft 160 (described below).

The platen roller 50 is made of rubber. The two ends of the platen roller 50 are rotably supported to hang between the inner side walls 23*b* (refer to FIG. 4), 24*b* of the gear boxes 23, 24 and cross beside the main body 22.

The platen roller 50 is beside the end of the paper guide surface 22*a* on the Y1 side, and the height of the top of the platen roller 50 is approximately the same as the height of the paper guide surface 22*a* on the Y1 side. Between the platen roller 50 and the main body 22, a paper-channel 28 is formed (refer to FIG. 1B and FIG. 2B), which is used for conveying paper of a usual thickness to move from the paper-feeding entrance 26 to a paper exit 27.

As shown in FIG. 4, a gear 83 is fixed to an axis of the platen roller 50, which is inserted into the gear box 24.

The turning blade driving motor 30 is a stepping motor, and is arranged on the X1 side of the main body 22. The spindle of the motor 30 is inserted into the gear box 23.

As shown in FIG. 5, the turning blade driving gear series 70 for speed reduction is arranged in the gear box 23. The turning blade driving gear series 70 includes gears 71, 72, 73. Namely, the gear 73 is the last gear.

The platen roller driving motor 40 is also a stepping motor, and is arranged on the X2 side of the main body 22. The spindle of the motor 40 is inserted into the gear box 24.

As shown in FIG. 4, the platen roller driving gear series 80 for speed reduction is arranged in the gear box 24. The platen roller driving gear series 80 includes gears 81, 82, 83.

The gear box 23 and the gear box 24 are covered by covering members 29*a* and 29*b*.

The fixed blade 60 is a rectangular plate, and includes a blade portion 61 and a holding portion 62. The blade portion 61 is supported by the holding portion 62 and perpendicularly faces the Z1 direction. The holding portion 62 is attached to an end of the first frame 21 on the Y1 side. That is, the fixed blade 60 is hanged between inner walls of the gear box 23 and the gear box 24 at a position on the Y1 side of the platen roller 50, and can be displaced in the Z2 direction against the elastic force of the holding portion 62.

The portion of the first module 20 between the gear boxes 23, 24 is accommodated in the depressed space 25. As described below, this space 25 accommodates the second module 100.

Second Module 100

Below, the second module 100 is explained with reference to FIG. 3 through FIG. 6.

As illustrated in FIG. 3 through FIG. 6, the second module 100 includes a second frame 101, a third frame 110, a thermal head 120 serving as a printing head, a head-pressuring springy member 130, a turning blade 140, an un-lock lever 150, and a lock-shaft 160. The second frame 101 and the third frame 110 constitutes a frame of the second module 100.

The thermal head 120 includes a ceramic plate 121 and a thermal head portion 122. The thermal head portion 122 is line-shaped along the X1-X2 direction and embedded in a portion of the lower surface of the ceramic plate 121. Connectors 123, 124 are attached to the upper surface of the ceramic plate 121.

The second frame 101 is roughly of a U-shape when viewed from the Z1 side, includes a main body 102, arm portions 103, 104 on two sides of the main body 102, and a supporting portion 105 which is of approximately a T shape, and projects from the main body 102 in the space between the arm portions 103, 104.

An end of the head-pressuring springy member 130, which is of a V-shape when viewed from the X1 side, is fixed to an end of the approximately T shape supporting portion 105.

The thermal head 120 is supported on the inner side of the second frame 101. A portion of the thermal head portion 122 is held by the end of the head-pressuring springy member 130 in the Z1 direction.

The un-lock lever 150 is turnably attached to the inner side of the arm portion 104.

The lock-shaft 160 is fixed to the un-lock lever 150, and crosses over the arm portions 103, 104. The two ends of the lock-shaft 160 penetrate through slits in the arm portions 103, 104, and project outside. Within the ranges of the slits, the lock-shaft 160 can be moved in the Y1-Y2 direction. An initializing spring 151 is provided on the un-lock lever 150.

As shown in FIG. 7, the turning blade 140 includes a main body 141, which is a die-casting formed of zinc, aluminum, or magnesium, or is made of a sintered metal, and a plate-like blade 142 is fixed to the main body 141. That is to say, the main body 141 is a molded part. The plate-like blade 142 has a curved blade portion 143.

The two ends of the turning blade 140 are rotably supported by arm portions on two sides of the third frame 110, and are further supported on the inner sides of the third frame 110. A gear 147, acting as a turning blade gear, is provided at an end of the turning blade 140, and the gear 147 is located outside of the third frame 110. An initializing spring 145 is provided on the turning blade 140 for resetting the turning blade 140 to an initial position.

Usually, a turning blade can be fabricated by cutting a column, but the turning blade 140 as described above can be fabricated at low cost compared to the turning blade fabricated by cutting a column.

The third frame 110, which supports the turning blade 140, is fixed to the main body 102 of the second frame 101.

With the second module 100 having the above structure, pins 23*c* and 24*c* projecting from the inner side walls 23*b*, 24*b* of the gear boxes 23, 24 of the first frame 21 are engaged with holes 105*a*, 105*b*, respectively, in the front ends of the arm portions 103, 104 on the two sides of the second frame 101 by a hinge joint, and the Y1 side of the second module 100 is movable in the Z1 direction. That is, the second module 100 is connected to the first module 20 in such a way that the second module 100 is rotable within a certain range relative to the first module 20 so that the second module 100 can be opened and closed.

In the second module 100 and the first module 20 which are connected by the hinge joint, when the second module 100 is closed, the thermal head portion 122 faces the top of the platen roller 50, and the turning blade 140 faces the blade portion 61 of the fixed blade 60.

Thermal Printer Device 10 Under Printing Condition

As shown in FIG. 1A and FIG. 1B, when the second module 100 is closed, the second module 100 is accommodated in the depressed space 25 between the gear boxes 23, 24 of the first module 20, the two ends of the lock-shaft 160 are engaged with the cut-outs 23*a*, 24*a*, and the second module 100 is locked at four locations A, B, C, D, so that the second module 100 is connected to the first module 20 to form an integral piece.

In the thermal printer device 10, since the second module 100 is accommodated in the depressed space 25 between the gear boxes 23, 24 of the first module 20, the thermal printer device 10 becomes a rectangular solid, there is no projection above the gear boxes 23, 24, and the height of the thermal printer device 10 equals R as shown in FIG. 1B; thus the height of the thermal printer device 10 is small.

Further, as shown in the enlarged view in FIG. 1C, the thermal head portion 122 is pressed by the elastic force of the head-pressuring springy member 130 against the platen roller 50, thereby, forming the printing unit 200.

In addition, the turning blade 140 approaches and faces the blade portion 61 of the fixed blade 60 from the Z1 side, and the gear 147 meshes with the gear 73, thereby forming the cutter unit 210.

Further, the paper-channel 220 is formed between the ceramic plate 121 and the paper guide surface 22*a*, which is along a straight line, and inclined downward.

In such formed cutter unit 210, the turning blade 140 is at an initial turning position, and there exists a gap 211 between the turning blade 140 and the fixed blade 60 for passing through paper.

Under such conditions, the thermal printer device 10 is able to print.

Operations

When the second module 100 is closed, an un-illustrated automatic document feeding device is in operation, thermosensitive paper thicker than 150 μm is fed in a direction J as shown in FIG. 1B, the end of the thermosensitive paper is conveyed in the paper-channel 220 and is caught between the platen roller 50 and the thermal head 120; hence the platen roller 50 and the thermal head 120 face each other with the thick thermosensitive paper in between.

In accordance with a printing command, the thermal head portion 122 is driven to operate and is heated. At the same time, the platen roller driving motor 40 is driven to operate, and it drives, through the platen roller driving gear series 80, the platen roller 50 to rotate; thereby the platen roller 50 and the thermal head 120 face each other with the thick thermosensitive paper in between. The thermal head portion 122 prints on the thick thermosensitive paper, and then the thick thermosensitive paper is conveyed. The printed portion of the thick thermosensitive paper passes through the gap 211, passes through the cutter unit 210, and then is delivered through an exit 221.

The heat generated in the thermal head portion 122 is dissipated through the second frame 101, which functions as a heat sink. When the printing operation is finished, in accordance with a cutting command, the turning blade driving motor 30 is driven to operate, and the turning blade 140 is driven to turn through the turning blade driving gear series 70 and the gear 147, and the main body 141 of the turning blade 140 starts to turn while pushing the blade portion 61 of the fixed blade 60 in the Z2 direction, when the turning blade 140 turns by 90 degrees, the printed portion of the paper is cut. Afterward, the turning blade driving motor 30 continues to drive, and the turning blade 140 returns to the initial position after one turn.

For example, cutting of the thick thermosensitive paper starts from one side in the width direction of the paper. Specifically, turning of the turning blade 140 is stopped when the cutting position is close to a final position, and then the turning blade 140 is driven to turn in reverse and move back. In other words, partial cutting is performed, that is, a certain portion of the thick thermosensitive paper on one side thereof in the width direction is not cut but remains connected.

In the present embodiment, since the turning blade 140 is used, which has a rigidity higher than that of a plate-like blade, even when the paper to be printed is the thermosensitive paper which is thicker than 150 μm, the cutter unit 210 can still deal with such kind of paper, and is sufficiently durable thus having a long service life.

In addition, since the paper-channel 220 is of a straight line type, the thick thermosensitive paper does not receive a strong resistance inside the thermal printer device 10, and can be conveyed smoothly.

For thin thermosensitive paper, as shown by an arrow K in FIG. 1B, the thin thermosensitive paper is fed from the paper-feeding entrance 26 at the bottom, and is directed to the platen roller 50 through the paper-channel 28. The thin thermosensitive paper is bent by the platen roller 50, and then, the thin thermosensitive paper is printed and is cut, just like the thick thermosensitive paper.

For maintenance, as shown in FIG. 2A and FIG. 2B, the un-lock lever 150 is moved in the Y2 direction to unlock the engagement at the locations C and D, and the Y1 side of the second module 100 is pulled up to open the thermal printer device 10. Thus, the gear 147 is separated from the gear 73, and the turning blade 140 is reset to the initial turning position by the initializing spring 145.

In this case, since the gear 147 is separated from the gear 73, the rotation transmission channel from the turning blade driving motor 30 to the turning blade 140 is blocked; therefore, even when power of the thermal printer device 10 is turned on erroneously, and the turning blade driving motor 30 is driven to operate, the turning blade 140 does rotate, and it is possible to avoid the risk of finger injury of an operator caused by malfunction of the turning blade 140.

In addition, when the thermal printer device 10 is opened, covering members may be provided to cover the fixed blade 60 and the turning blade 140, and this also prevents finger injury of the operator. This is described below.

Second Embodiment

Figure 8:
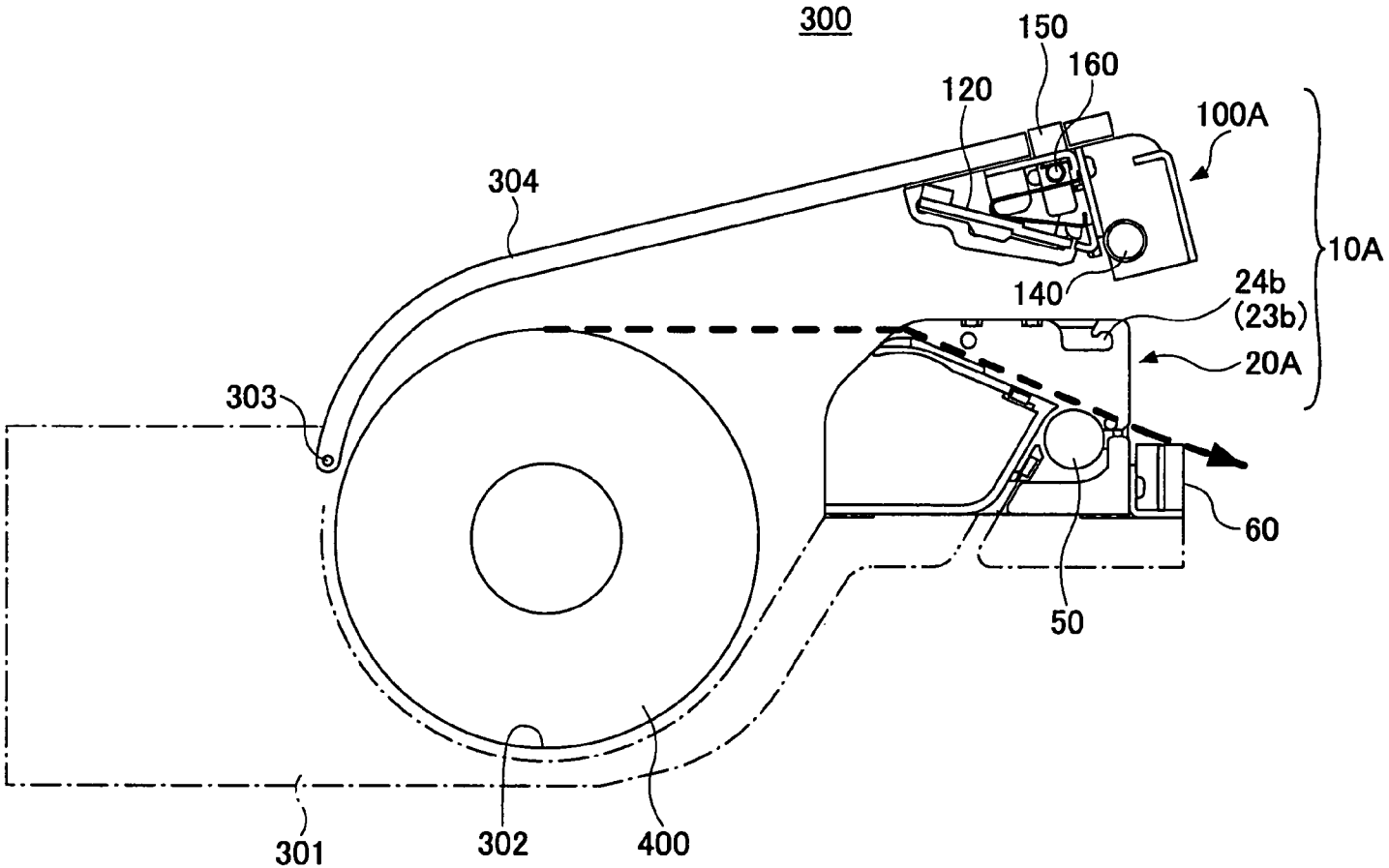
FIG. 8 is a cross-sectional view of a thermal printer device 10A according to a second embodiment of the present invention.

FIG. 8 is a cross-sectional view of a thermal printer device 10A according to a second embodiment of the present invention.

The thermal printer device 10A shown in FIG. 8 has a structure basically the same as that of the thermal printer device 10 shown in FIG. 1A through FIG. 6, except that the hinge joint portion of the thermal printer device 10, which includes holes 105*a*, 105*b*, and pins 23*c*, 24*c*, is omitted in the thermal printer device 10A.

Similar to the thermal printer device 10 shown in FIG. 1A through FIG. 6, the thermal printer device 10A includes a first module 20A and a second module 10A, and the second module 100A can be completely separated from the first module 20A. The thermal printer device 10A can be installed in a Clamshell type portable terminal apparatus.

A Clamshell type portable terminal apparatus 300 shown in FIG. 8 includes a chassis 301, which has a roll paper holder 302 for accommodating thermosensitive paper 400, a cover 304, and an axle 303 which is connected to the chassis 301 by a hinge joint so that the cover 304 can be opened and closed. The first module 20A is fixed to the chassis 301, and the second module 100A is fixed to the lower side of the cover 304 near an end of the cover 304.

When replenishing the thermosensitive paper 400, the cover 304 is opened, the thermosensitive paper 400 is replenished, then the end of the thermosensitive paper 400 is pulled out, and then the cover 304 is closed. Thereby, the two ends of the lock-shaft 160 are engaged with the cut-outs 23*a*, 24*a*, the second module 100A overlaps the first module 20A and is locked at two locations C, D of the first module 20A (refer to FIG. 1A), and further constrained by the axis 303; thus the second module 100A is connected to the first module 20A to form an integral piece.

The printing and cutting operations of the thermal printer device 10A are the same as the thermal printer device 10 as described above.

Third Embodiment

Figure 9A:
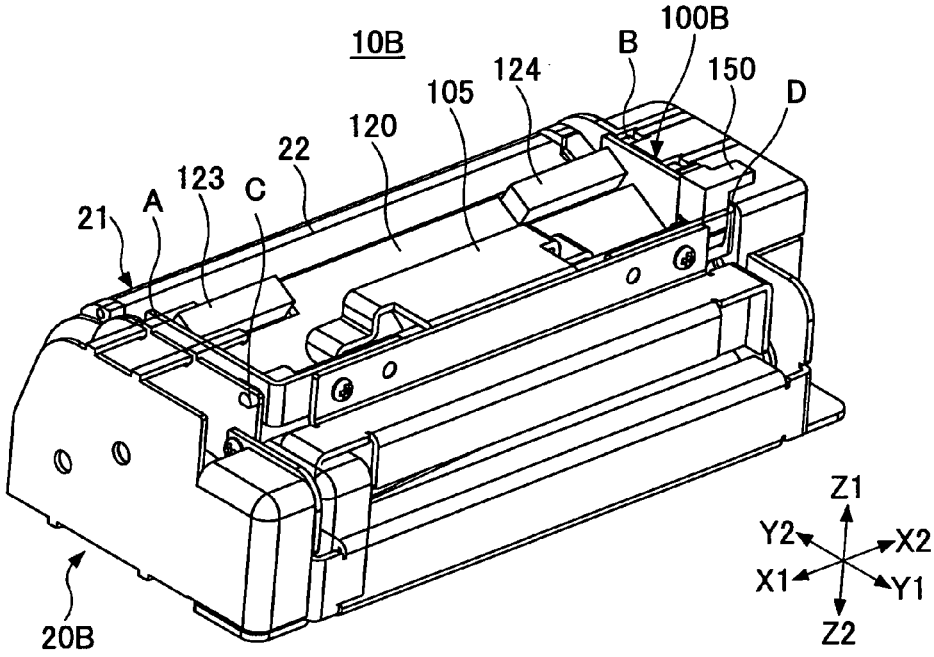
FIG. 9A is a perspective view illustrating a configuration of a thermal printer device 10B under a usual condition according to a third embodiment of the present invention.

FIG. 9A is a perspective view illustrating a configuration of a thermal printer device 10B under a usual condition according to a third embodiment of the present invention.

Figure 9B:
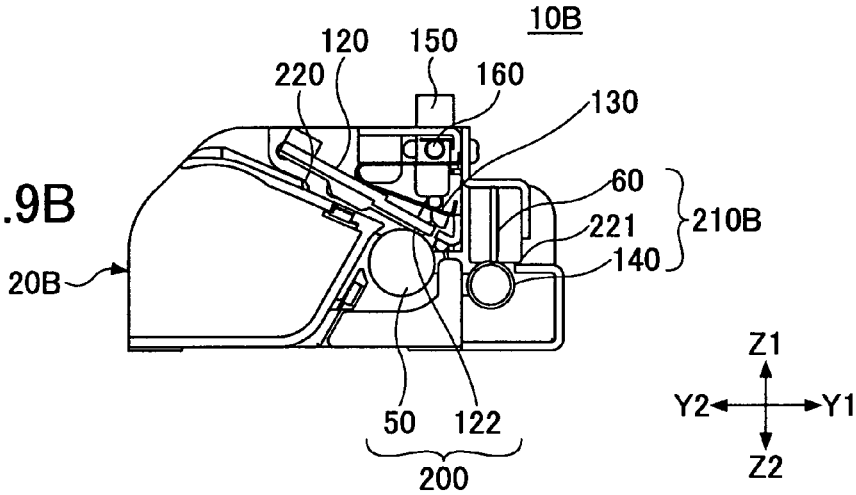
FIG. 9B is a cross-sectional view of the thermal printer device 10B as shown in FIG. 9A.

FIG. 9B is a cross-sectional view of the thermal printer device 10B as shown in FIG. 9A.

Figure 9C:
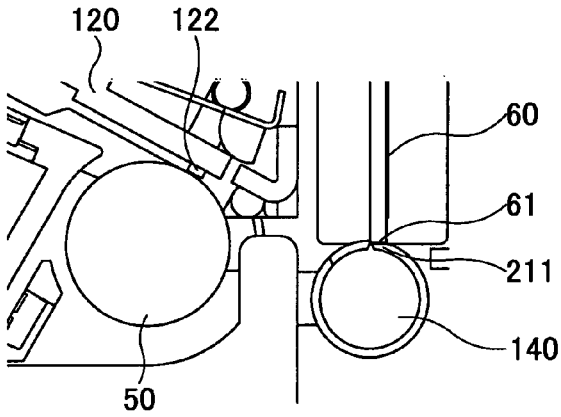
FIG. 9C is an enlarged cross-sectional view of a printer unit 200 and a cut unit 210B of the thermal printer device 10B as shown in FIG. 9A.

FIG. 9C is an enlarged cross-sectional view of a printer unit 200 and a cut unit 210B of the thermal printer device 10B as shown in FIG. 9A.

Figure 10A:
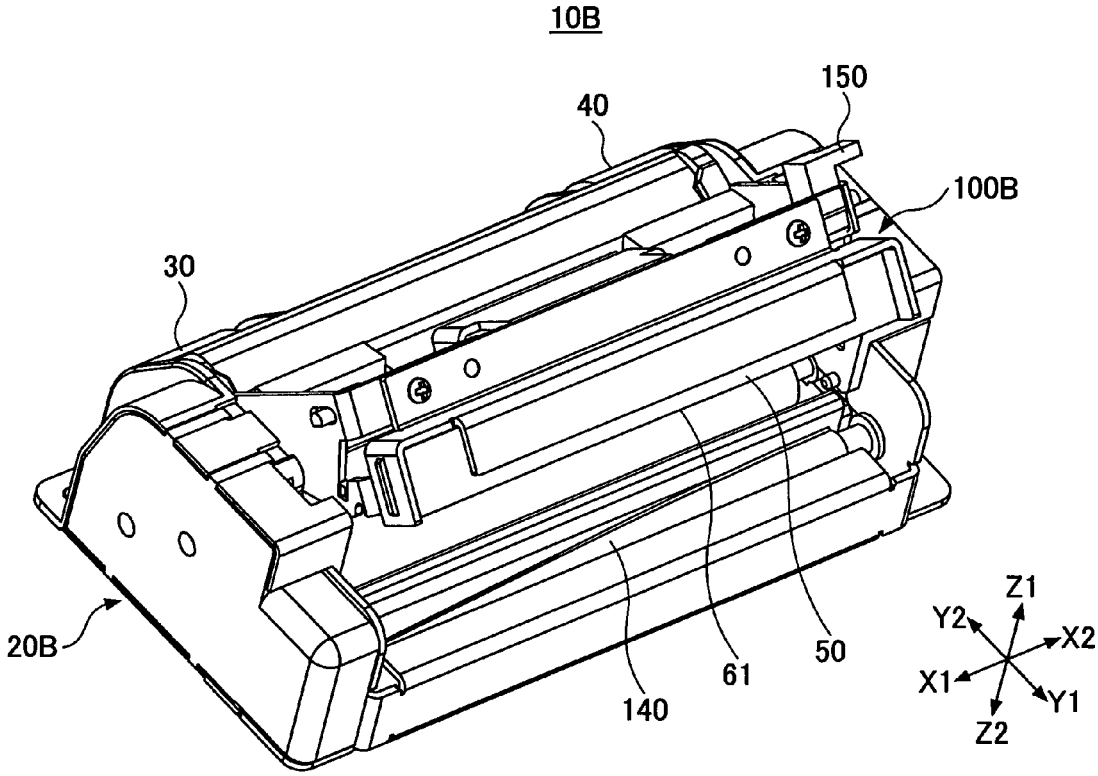
FIG. 10A is a perspective view illustrating a configuration of the thermal printer device 10B under a maintenance condition.

FIG. 10A is a perspective view illustrating a configuration of the thermal printer device 10B under a maintenance condition.

Figure 10B:
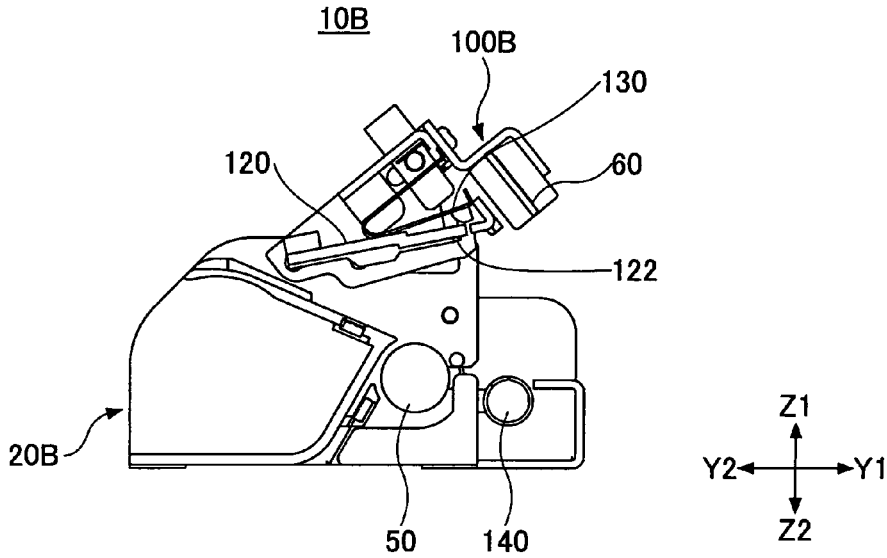
FIG. 10B is a cross-sectional view of the thermal printer device 10B as shown in FIG. 10A.

FIG. 10B is a cross-sectional view of the thermal printer device 10B as shown in FIG. 10A.

The thermal printer device 10B shown in FIG. 9A through FIG. 10B has a structure basically the same as that of the thermal printer device 10 shown in FIG. 1A through FIG. 6, except that the fixed blade 60 and the turning blade 140 are interchanged compared to the thermal printer device 10 shown in FIG. 1A through FIG. 6.

As shown in FIG. 9A through FIG. 10B, the first module 20B includes the turning blade driving motor 30, the platen roller driving motor 40, the platen roller 50, the turning blade 140, the turning blade driving gear series 70, and the platen roller driving gear series 80. The turning blade driving motor 30, the platen roller driving motor 40, the platen roller 50, and the turning blade 140 are mounted on the first frame 21.

The second module 100B includes the second frame 101, the thermal head 120, the head-pressuring springy member 130, the fixed blade 60, the un-lock lever 150, and a lock-shaft 160.

The second module 100B is connected to the first module 20B by a hinge joint so that the second module 100B can be opened and closed. The second module 100B is connected to the first module 20B at four locations so that the second module 100B overlaps the first module 20B, and the second module 100B and the first module 20B are integrated as one piece.

Further, as shown in the enlarged view in FIG. 9C, the printing unit 200, the cutter unit 210B, and the paper-channel 220 are formed. Specifically, the fixed blade 60 approaches the turning blade 140 from the Z1 side, thereby forming the cutter unit 210B.

The printing and cutting operations of the thermal printer device 10B are the same as the thermal printer device 10 as described above.

For maintenance, as shown in FIG. 10A and FIG. 10B, the un-lock lever 150 is moved in the Y2 direction to unlock the engagement at the locations C and D, and the Y1 side of the second module 100B is pulled up to open a portion of the thermal printer device 10B.

Fourth Embodiment

Figure 11:
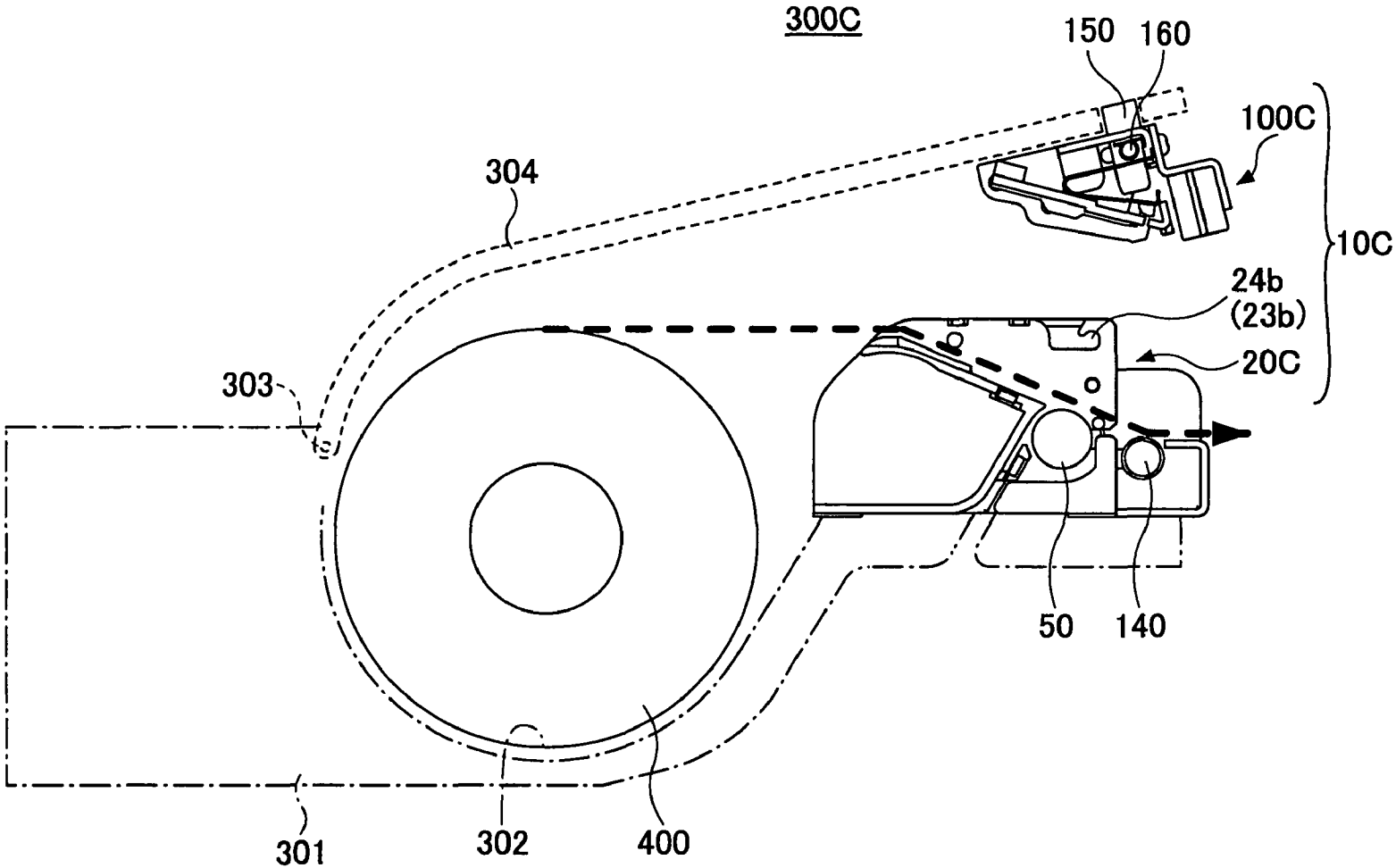
FIG. 11 is a cross-sectional view of a thermal printer device 10C according to a fourth embodiment of the present invention.

FIG. 11 is a cross-sectional view of a thermal printer device 10C according to a fourth embodiment of the present invention.

The thermal printer device 10C shown in FIG. 11 has a structure basically the same as that of the thermal printer device 10A shown in FIG. 9A through FIG. 10B, except that the hinge joint portion of the thermal printer device 10B is omitted in the thermal printer device 10C.

Similar to the thermal printer device 10A shown in FIG. 9A through FIG. 10B, the thermal printer device 10C includes a first module 20C and a second module 100C, and the second module 100C can be completely separated from the first module 20C. The thermal printer device 10C can be installed in a Clamshell type portable terminal apparatus.

A Clamshell type portable terminal apparatus 300C shown in FIG. 11 includes a chassis 301, which has a roll paper holder 302 for accommodating thermosensitive paper 400, a cover 304, and an axle 303 which is connected to the chassis 301 by a hinge joint so that that the cover 304 can be opened and closed. The first module 20C is fixed to the chassis 301, and the second module 100C is fixed to the lower side of the cover 304 near an end of the cover 304.

When supplying the thermosensitive paper 400, the cover 304 is opened, the thermosensitive paper 400 is supplied, then the end of the thermosensitive paper 400 is pulled out, and then the cover 304 is closed. Thereby, the two ends of the lock-shaft 160 are engaged with the cut-outs 23*a*, 24*a*, the second module 100C overlaps the first module 20C, and is locked at two locations C, D of the first module 20C (refer to FIG. 1A), and further constrained by the axle 303; thus the second module 100C is connected to the first module 20C to form an integral piece.

The printing and cutting operations of the thermal printer device 10C are the same as the thermal printer device 10 as described above.

Fifth Embodiment

Figure 12A:
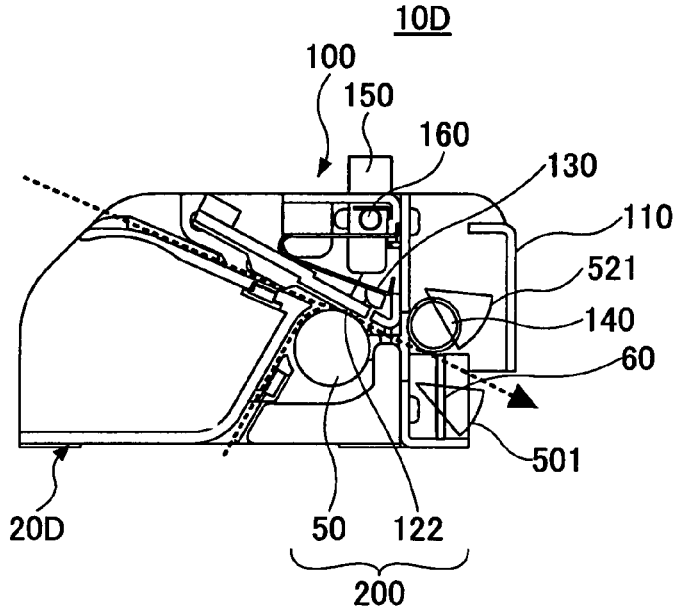
FIG. 12A and FIG. 12B are cross-sectional views illustrating a configuration of a thermal printer device 10D according to a fifth embodiment of the present invention.
Figure 12B:
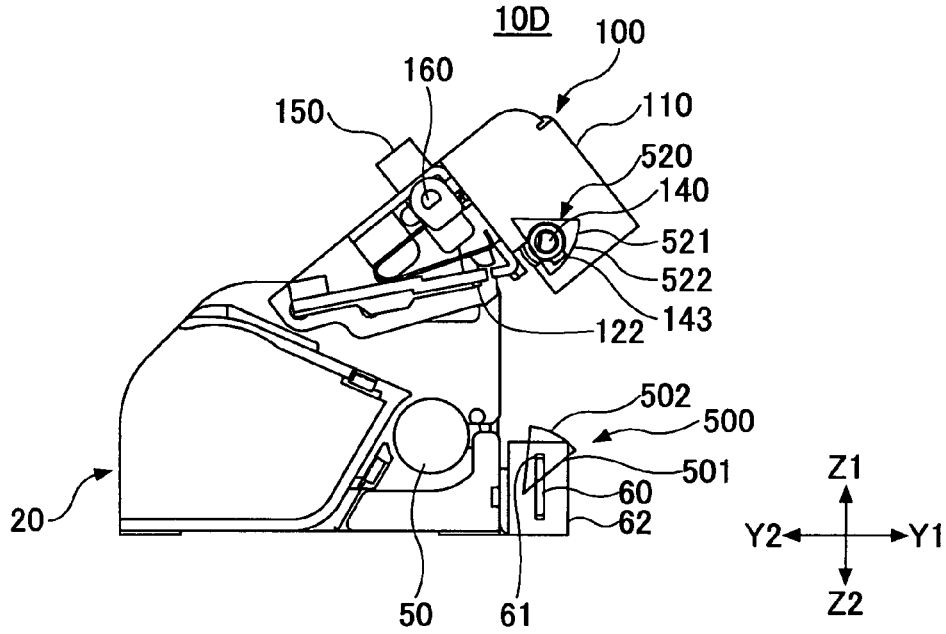

FIG. 12A and FIG. 12B are cross-sectional views illustrating a configuration of a thermal printer device 10D according to a fifth embodiment of the present invention.

The thermal printer device 10D shown in FIG. 12A and FIG. 12B has a structure basically the same as that of the thermal printer device 10 shown in FIG. 1A through FIG. 6, except that a fixed blade protection cover mechanism 500 and a turning blade protection cover mechanism 520 are additionally provided in the thermal printer device 10D.

As shown in FIG. 12B, the first module 20D includes an additional fixed blade protection cover mechanism 500, and the second module 100D includes an additional turning blade protection cover mechanism 520 compared to the first module 20 and the second module 100 as shown in FIG. 1A through FIG. 1C.

Figure 13:
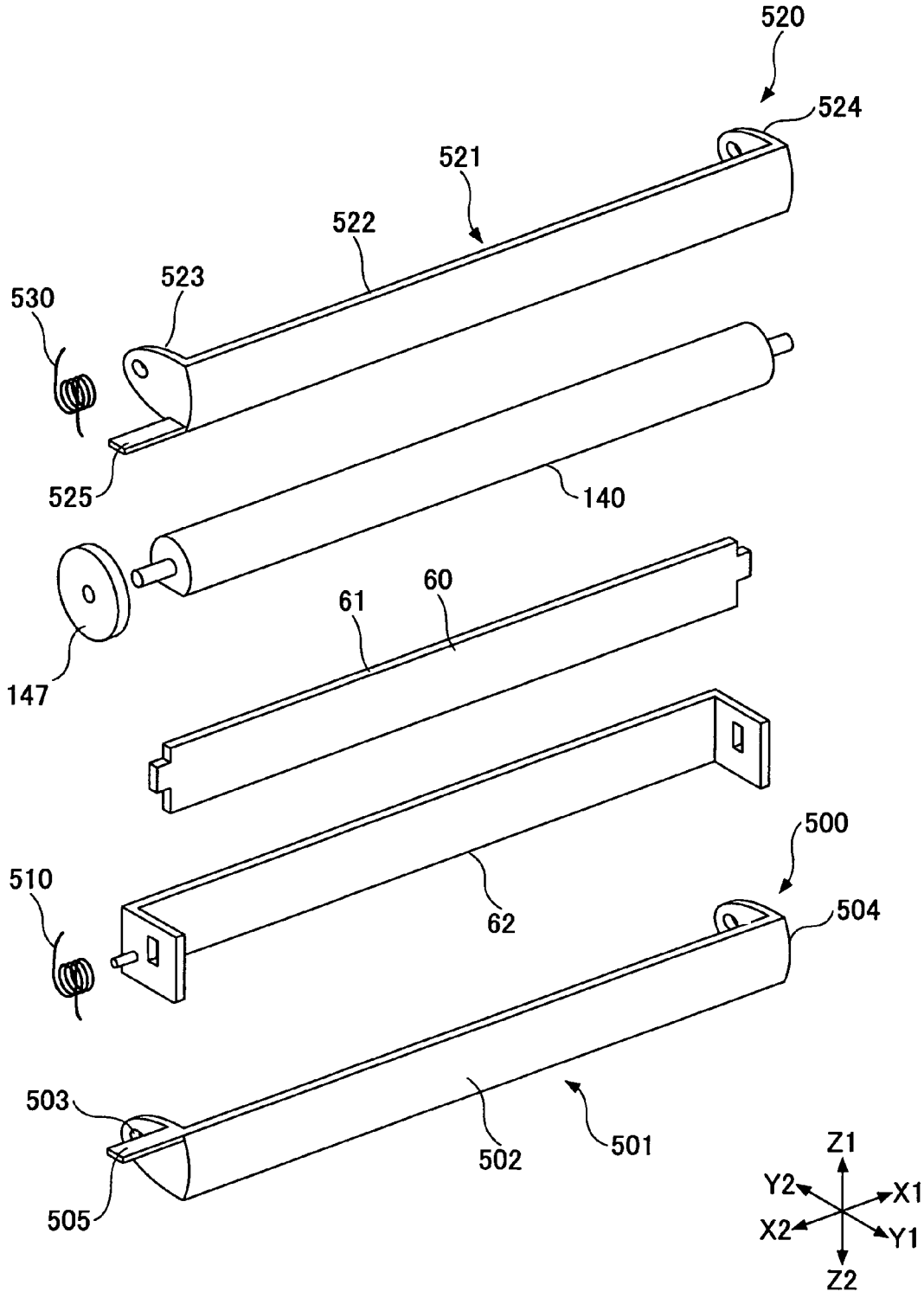
FIG. 13 is an exploded perspective view of the fixed blade protection cover mechanism 500 and the turning blade protection cover mechanism 520.

FIG. 13 is an exploded perspective view of the fixed blade protection cover mechanism 500 and the turning blade protection cover mechanism 520.

As shown in FIG. 13, the fixed blade protection cover mechanism 500 includes a fixed blade protection cover member 501 and a twisted coil spring 510.

The fixed blade protection cover member 501 has an elongated plate 502, arms 503, 504 one at each end of the plate 502, and a lag 505 projecting from the arm 503. Un-illustrated pins of a holding member 62 are engaged with holes at the ends of the arms 503, 504 to allow the fixed blade protection cover member 501 to be rotably supported, and the fixed blade protection cover member 501 is turned in the counter-clock direction by the elastic spring force of the twisted coil spring 510.

As shown in FIG. 12B, the fixed blade protection cover member 501 is at a position allowing the blade portion 61 of the fixed blade 60 to be covered by the elongated plate 502 of the fixed blade protection cover member 501. Below, this position is referred to as "a covering position".

The turning blade protection cover mechanism 520 includes a turning blade protection cover member 521 and a twisted coil spring 530.

The turning blade protection cover member 521 has an elongated plate 522, arms 523, 524 one at each end of the plate 522, and a lag 525 projecting from the arm 523. Un-illustrated pins on the inner side of the third frame 110 are engaged with holes at the ends of the arms 523, 524 to allow the turning blade protection cover member 521 to be rotably supported, and the turning blade protection cover member 521 is turned in the counter-clock direction by the elastic spring force of the twisted coil spring 530.

As shown in FIG. 12B, the turning blade protection cover member 521 is at a position allowing the blade portion 143 of the turning blade 140 to be covered by the elongated plate 522 of the turning blade protection cover member 521. That is, the turning blade protection cover member 521 is at the covering position.

As shown in FIG. 12B, when the second module 100D is pressed down to be connected to the first module 20D (FIG. 12A shows where the second module 100D is connected to the first module 20D), a portion of the second module 100D pushes the lag 505, and against the spring force of the twisted coil spring 510, the fixed blade protection cover member 501 turns in the clockwise direction; thereby, the lag 505 is engaged with a portion of the first module 20D, and against the spring force of the twisted coil spring 520, the turning blade protection cover member 521 turns in the clockwise direction.

The fixed blade protection cover member 501 and the turning blade protection cover member 521 are moved to respective positions as shown in FIG. 12A. The positions of the fixed blade protection cover member 501 and the turning blade protection cover member 521 shown in FIG. 12A are referred to as "escaping positions", which do not hinder the cutting operations of the cutter unit 210.

Under the conditions shown in FIG. 12A and FIG. 12B, the printing and cutting operations of the thermal printer device 10D are the same as the thermal printer device 10 as described above.

For maintenance, the un-lock lever 150 is operated to unlock the second module 100D, and the Y1 side of the second module 100D is pulled up to open the thermal printer device 10D. In this process, the second module 100D separates from the lag 505, and due to the spring force of the twisted coil spring 510, the fixed blade protection cover member 501 turns in the counter-clockwise direction. In addition, the first module 20D separates from the lag 525, and due to the spring force of the twisted coil spring 520, the turning blade protection cover member 521 turns in the counter-clockwise direction.

The fixed blade protection cover member 501 and the turning blade protection cover member 521 are moved to the respective covering positions as shown in FIG. 12B, where the blade portion 61 of the fixed blade 60 is covered by the elongated plate 502 of the fixed blade protection cover member 501, and the blade portion 143 of the turning blade 140 is covered by the elongated plate 522 of the turning blade protection cover member 521. Therefore, it is possible to prevent a serviceman in maintenance from touching the blade portions 61, 143 with fingers and prevent fingers of the serviceman in maintenance from being injured.

It should be noted that one of the fixed blade protection cover mechanism 500 and the turning blade protection cover mechanism 520 can be omitted.

Figure 14A:
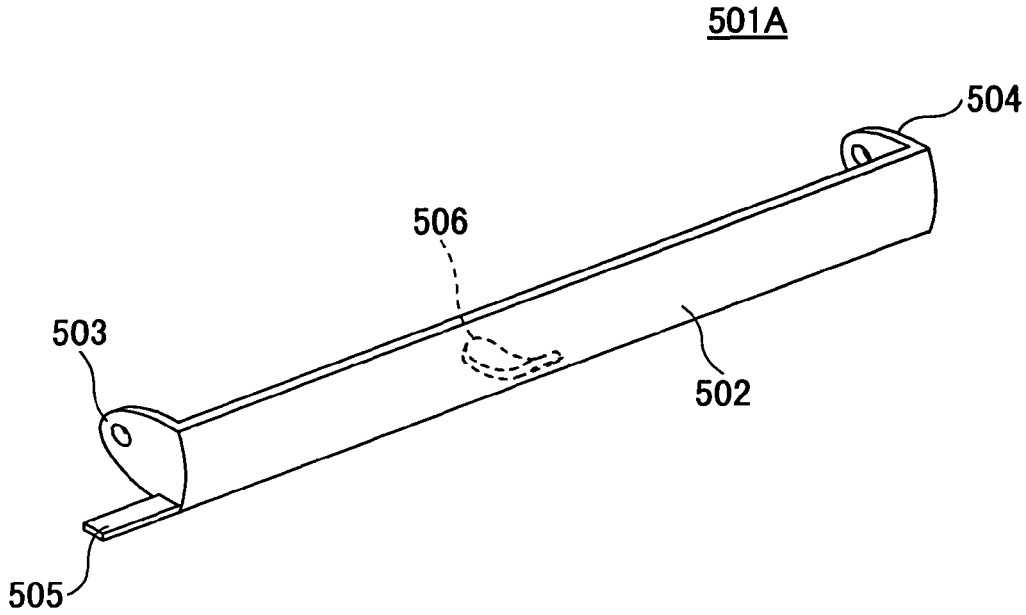
FIG. 14A through FIG. 14C are a perspective view and two cross-sectional views illustrating a modification of the fixed blade protection cover member.
Figure 14B:
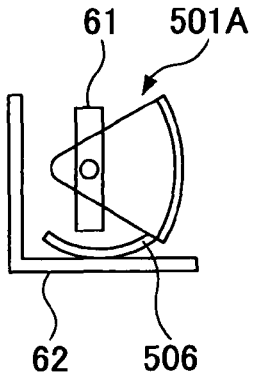
Figure 14C:
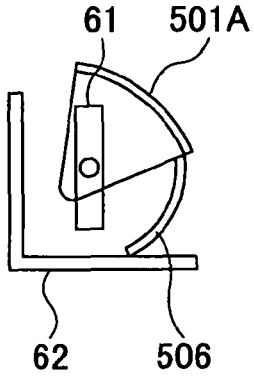

FIG. 14A through FIG. 14C are a perspective view and two cross-sectional views illustrating a modification of the fixed blade protection cover member.

As shown in FIG. 14A, a fixed blade protection cover member 501A includes a spring plate 506, which projects from the elongated plate 502. As shown in FIG. 14B and FIG. 14C, the spring plate 506 touches the holding portion 62 and is bent, thus the spring plate 506 functions as the twisted coil spring 510.

FIG. 14B shows that the fixed blade protection cover member 501A is at the escaping position, and FIG. 14C shows that the fixed blade protection cover member 501A is at the covering position.

Sixth Embodiment

Figure 15:
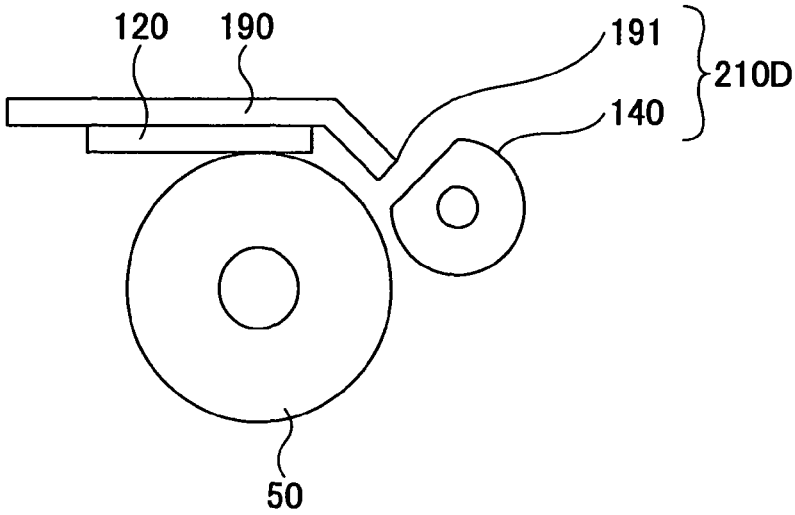
FIG. 15 is a cross-sectional view illustrating a second example of the cutter unit according to a sixth embodiment of the present invention.

FIG. 15 is a cross-sectional view illustrating a second example of the cutter unit according to a sixth embodiment of the present invention.

Figure 16:
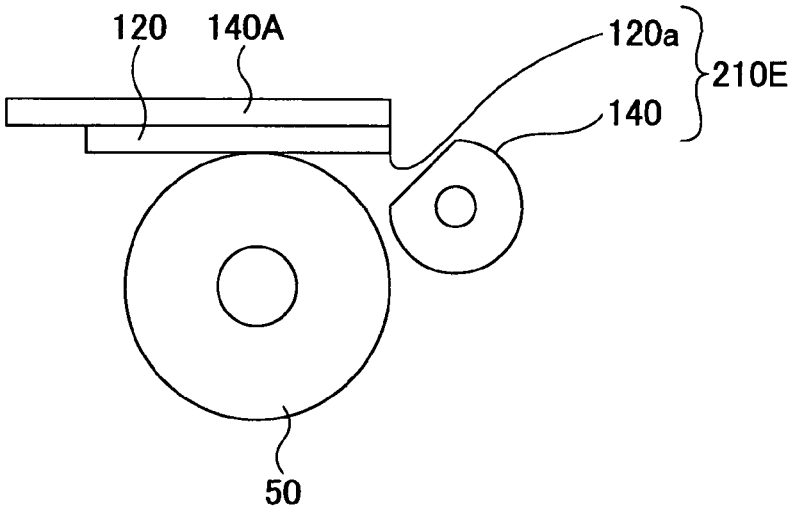
FIG. 16 is a cross-sectional view illustrating a third example of the cutter unit.

FIG. 16 is a cross-sectional view illustrating a third example of the cutter unit.

FIG. 15 shows a cutter unit 210D, which is a modification of the cutter unit 210B of the thermal printer devices 10B and 10C as shown in FIG. 9A through FIG. 9C, and FIG. 11. In the cutter unit 210D, an end 191 of a heat sink 190 fixed to the thermal head 120 is used as the blade portion of a fixed blade.

FIG. 16 shows a cutter unit 210E, which is another modification of the cutter unit 210B of the thermal printer devices 10B and 10C as shown in FIG. 9A through FIG. 9C, and FIG. 11. In the cutter unit 1210E, an end 121*a* of a ceramic plate 121 of the thermal head 120 is used as the blade portion of a fixed blade.

While the invention is described above with reference to specific embodiments chosen for purpose of illustration, it should be apparent that the invention is not limited to these embodiments, but numerous modifications could be made thereto by those skilled in the art without departing from the basic concept and scope of the invention.

For example, a printing head other than the thermal head 120 may be used in the above various printer devices.

In a printer device, the first module 20 (or one of 20A through 20C) may be arranged to be turnable or movable, and the second module 100 (or one of 100A through 100C) may be fixed, and the first module 20 (or one of 20A through 20C) may be turned or moved to be connected to the second module 100 (or one of 100A through 100C).

The present invention can be applied to a printer device of a portable terminal apparatus having a cutter function.

This patent application is based on Japanese Priority Patent Application No. 2007-113187 filed on Apr. 23, 2007, the entire contents of which are hereby incorporated by reference.

What is claimed is:

1. A printer device, comprising:

a first module; and a second module;

wherein the first module includes a first frame including a plurality of cutouts defined therein, a turning blade driving motor, a platen roller driving motor, a platen roller driven to rotate by the platen roller driving motor, and a fixed blade, said turning blade driving motor, said platen roller driving motor, said platen roller, and said fixed blade are provided on the first frame, and the second module includes a second frame having opposing arm portions, wherein each arm portion includes a slit corresponding to the cutouts, respectively, a lock shaft having two ends and being movable in a depth direction of the printer device within the slits, wherein the two ends of the lock shaft penetrate through the slits, respectively, project outside the arm portions and are selectively received by the corresponding cutouts, a printing head, and a turning blade, said printing head and said turning blade are provided on the second frame, when the first module and the second module are connected together, the printing head faces the platen roller, the turning blade faces the fixed blade, the lock shaft is received by the slits and cutouts, and rotation of the turning blade driving motor is transmitted to the turning blade, wherein the printer device comprises a first side along a width direction of the printer device and a second side along the width direction, and when the first module and the second module are connected together, the second module is connected to the first module at two locations on the first side and at two locations on the second side, the two locations on the first side being points of contact between the lock shaft and the cutouts.

2. The printer device as claimed in claim 1, wherein the first module further includes a turning blade driving gear series that is provided on the first frame to transmit the rotation of the turning blade driving motor, the second module further includes a turning blade gear provided at an end of the turning blade, when the first module and the second module are connected together, the turning blade gear meshes with one gear of the turning blade driving gear series.

3. The printer device as claimed in claim 1, wherein the printing head and the platen roller face each other, the turning blade and the fixed blade face each other, and the turning blade and fixed blade are downstream of a paper channel in a direction of movement of the paper, the paper channel being formed between the first module and the second module.

4. The printer device as claimed in claim 1, wherein the first frame includes a main body at a center, and gear boxes on two sides of the main body and projecting out of the main body, the main body is depressed relative to the gear boxes on the two sides thereof, the second module is accommodated in the depression.

5. The printer device as claimed in claim 1, wherein the second module is movably attached to a place on an inner side of the gear boxes on two sides thereof.

6. The printer device as claimed in claim 1, wherein the second module is separatable from the first module.

7. The printer device as claimed in claim 1, wherein the turning blade includes an initializing spring for resetting the turning blade to an initial position.

8. The printer device as claimed in claim 1, further comprising:

a protection cover mechanism that locates a protection cover member at an escaping position when the first module and the second module are connected together, and moves the protection cover member at a covering position to cover at least one of the turning blade and the fixed blade when the first module and the second module are disconnected.

9. The printer device as claimed in claim 8, wherein the protection cover mechanism moves the protection cover member by an elastic force of a spring from the escaping position to the covering position.

10. The printer device as claimed in claim 9, wherein the spring projects out of the protection cover member and is integrated with the protection cover member.

11. The printer device as claimed in claim 1, wherein the first module is stationary and the second module rotates relative to the first module.

12. The printer device as claimed in claim 1, further comprising an unlock lever at an inner portion of the second frame to move the lock shaft.

13. A printer device, comprising:

a first module; and a second module;

wherein the first module includes a first frame including a plurality of cutouts defined therein, a turning blade driving motor, a platen roller driving motor, a platen roller driven to rotate by the platen roller driving motor, and a turning blade driven to rotate by the turning blade driving motor, said turning blade driving motor, said platen roller driving motor, said platen roller, and said turning blade are provided on the first frame, and the second module includes a second frame having opposing arm portions, wherein each arm portion includes a slit corresponding to the cutouts, respectively, a lock shaft having tow ends and being movable in a depth direction of the printer device within the slits, wherein the two ends of the lock shaft penetrate through the slits, respectively, project outside the arm portions and are selectively received by the corresponding cutouts, a printing head, and a fixed blade, said printing head and said fixed blade are provided on the second frame, when the first module and the second module are connected together, the printing head faces the platen roller, the lock shaft is received by the slits and cutouts, and the turning blade faces the fixed blade, wherein the printer device comprises a first side along a width direction of the printer device and a second side along the width direction, and when the first module and the second module are connected together, the second module is connected to the first module at two locations on the first side and at two locations on the second side, the two locations on the first side being points of contact between the lock shaft and the cutouts.

14. The printer device as claimed in claim 13, wherein the turning blade includes a molded part serving as a main body of the turning blade, and a plate-like blade fixed to the main body.

15. The printer device as claimed in claim 13, wherein an end of a plate-like heat sink arranged on the printing head serves as the fixed blade.

16. The printer device as claimed in claim 13, wherein an end of a ceramic plate supporting the printing head serves as the fixed blade.

17. A printer device, comprising:

a first module; and a second module;

wherein the first module includes a first frame including a plurality of cutouts defined therein, a turning blade driving motor, a platen roller driving motor, a platen roller driven to rotate by the platen roller driving motor, and a fixed blade, said turning blade driving motor, said platen roller driving motor, said platen roller, and said fixed blade are provided on the first frame, and the second module includes a second frame, a lock shaft movable in a depth direction of the printer device to be selectively received by the cutouts, a printing head, and a turning blade, said printing head and said turning blade are provided on the second frame;

and an unlock lever at an inner portion of the second frame to move the lock shaft, when the first module and the second module are connected together, the printing head faces the platen roller, the turning blade faces the fixed blade, the lock shaft is received by the cutouts, and rotation of the turning blade driving motor is transmitted to the turning blade, wherein the printer device further includes a first side along a width direction of the printer device and a second side along the width direction, and when the first module and the second module are connected together, the second module is connected to the first module at two locations on the first side and at two locations on the second side, the two locations on the first side being points of contact between the lock shaft and the cutouts.

18. The printer device as claimed in claim 17, wherein the printing head and the platen roller face each other, the turning blade and the fixed blade face each other, and the turning blade and fixed blade are downstream of a paper channel in a direction of movement of the paper, the paper channel being formed between the first module and the second module.

19. The printer device as claimed in claim 17, wherein the first frame includes a main body at a center, and gear boxes on two sides of the main body and projecting out of the main body, the main body is depressed relative to the gear boxes on the two sides thereof, the second module is accommodated in the depression.

20. The printer device as claimed in claim 17, wherein the second module is movably attached to a place on an inner side of the gear boxes on two sides thereof.

21. The printer device as claimed in claim 17, wherein the second module is separatable from the first module.

22. The printer device as claimed in claim 17, wherein the turning blade includes an initializing spring for resetting the turning blade to an initial position.

23. The printer device as claimed in claim 17, further comprising:

a protection cover mechanism that locates a protection cover member at an escaping position when the first module and the second module are connected together, and moves the protection cover member at a covering position to cover at least one of the turning blade and the fixed blade when the first module and the second module are disconnected.

24. The printer device as claimed in claim 23, wherein the protection cover mechanism moves the protection cover member by an elastic force of a spring from the escaping position to the covering position.

25. The printer device as claimed in claim 24, wherein the spring projects out of the protection cover member and is integrated with the protection cover member.

26. The printer device as claimed in claim 17, wherein the first module is stationary and the second module rotates relative to the first module.

* * * * *

UNITED STATES PATENT AND TRADEMARK OFFICE

CERTIFICATE OF CORRECTION

PATENT NO. : 8,152,393 B2
APPLICATION NO. : 11/984682
DATED : April 10, 2012
INVENTOR(S) : Masahiro Tsuchiya et al.

It is certified that error appears in the above-identified patent and that said Letters Patent is hereby corrected as shown below:

Column 14, Line 35, In Claim 6, delete “separatable” and insert -- separable --, therefor.

Column 15, Line 15 (Approx.), In Claim 13, delete “tow” and insert -- two --, therefor.

Column 16, Line 43, In Claim 21, delete “separatable” and insert -- separable --, therefor.

Signed and Sealed this
Tenth Day of July, 2012

David J. Kappos

David J. Kappos
*Director of the United States Patent and Trademark Office*